US005500570A

United States Patent [19]

Jeong

[11] Patent Number: 5,500,570

[45] Date of Patent: Mar. 19, 1996

[54] HIGH-INTENSITY DISCHARGE LAMP WITH PLEATED ENDS

[75] Inventor: Eui-seon Jeong, Suwon, Rep. of Korea

[73] Assignee: Samsung Display Devices Co., Ltd., Kyungki, Rep. of Korea

[21] Appl. No.: 280,544

[22] Filed: Jul. 26, 1994

[30] Foreign Application Priority Data

Aug. 21, 1993 [KR] Rep. of Korea ..... 93-16314

[51] Int. Cl.[6] ..... H01J 61/30; H01J 61/33

[52] U.S. Cl. ..... 313/634; 313/11; 313/44; 313/110; 313/493; 220/2.1 R

[58] Field of Search ..... 313/634, 11, 27, 313/44, 493, 110; 220/2.1 R

[56] References Cited

U.S. PATENT DOCUMENTS 1,933,329 10/1933 Hull ..... 313/634 X 4,281,267 7/1981 Johnson ..... 313/44 X 4,677,338 6/1987 Dixon et al. ..... 313/634 X

FOREIGN PATENT DOCUMENTS 0163670 4/1980 Netherlands ..... 313/634

*Primary Examiner*—Donald J. Yusko

*Assistant Examiner*—Nimesh Patel

*Attorney, Agent, or Firm*—Leydig, Voit & Mayer

[57] ABSTRACT

A high-intensity discharge lamp includes a luminous tube in which predetermined rare gases and metal are sealingly filled, and a pair of electrodes provided at the ends, wherein irregular portions are formed at both ends of the luminous tube which surround the electrodes, thereby enhancing color rendering and luminous efficiency, and reducing a starting voltage.

15 Claims, 3 Drawing Sheets

HIGH-INTENSITY DISCHARGE LAMP WITH PLEATED ENDS

BACKGROUND OF THE INVENTION

The present invention relates to high-intensity discharge lamps such as a mercury lamp, natrium lamp and metal halide lamp (MHL), and more particularly, to a high-intensity discharge lamp in which the structure of its luminous tube is improved so as to improve luminous efficiency and color rendering.

Generally, lighting lamps of high brightness and long life are installed in street light fixtures and industrial work areas. Among such commercially available lamps, there are a high-intensity mercury lamp, a high-intensity natrium lamp and an MHL. Mercury lamps are the most widely used, and have a comparatively long lifetime. However, their luminous efficiency is somewhat poor and their luminous color is unappealing. Natrium lamps are best in view of luminous efficiency but their color rendering is somewhat poor. However, the MHL is better than the mercury lamp in view of luminous efficiency, and is best in view of color rendering. Accordingly, the use of MHL's is becoming more widespread. The cost of an MHL, however, is high and should be reduced in the near future. With MHLs being increasingly used, some prerequisites should be met. Particularly, in the field of interior design in which the illumination effects play an important role, such prerequisites can be satisfied when care is taken. Particularly, a small MHL which is used in the field of interior design should have low power consumption, high efficiency, high color rendering and a long lifetime. Here, the MHL which is chiefly used in an interior room will be described below.

FIG. 1 shows one example of a conventional MHL. Referring to FIG. 1, a pair of electrodes 2*a* and 2*b* are provided at both ends of a capsule-shaped luminous tube 1 made of quartz. Around each electrode is formed a zirconia heat-retaining layer 3. Also, luminous tube 1 is filled with predetermined rare gases, mercury and metal halide, and sealed. An outer tube 4 encloses luminous tube 1 and its accessories. Outer tube 4 is evacuated or sealed after being filled with nitrogen and inert gases. A socket connector 5 is provided on either end of outer tube 4, and is electrically connected with electrode 2*a* or 2*b*. Here, reference numeral 6 represents a getter which absorbs the remaining gas to increase the vacuum.

FIG. 2 is an enlarged view of the luminous tube of the lamp shown in FIG. 1. Referring to FIG. 2, luminous tube 1 is capsule-shaped and generally cylindrical. At the lengthwise ends of luminous tube 1 are provided electrodes 2*a* and 2*b*. From each electrode is drawn out a lead wire 7. To the respective lead wires 7 is installed a molybdenum thin plate 8 for maintaining a gas-tight seal. Also, as described above, on respective electrodes 2*a* and 2*b* is formed a heat-retaining layer 3, which prevents the temperature around the electrodes from decreasing.

However, in such a conventional MHL as above, when the lamp is in a state of illumination, the lower end of luminous tube 1 is cooled by convection of gas in the tube 1 and of nitrogen gas in outer tube 4, and becomes a minimum-temperature portion. Also, as a result of the temperature difference due to such convection, the arc created by discharge is bent upwards. Accordingly, the quartz luminous tube 1 is degraded by non-uniform local heating. On the other hand, the vapor pressure of the metal halide is varied depending upon the temperature of the minimum-temperature portion. Accordingly, condensation of the compounds in luminous tube 1 occurs by the cooling action in the lower end of luminous tube 1, resulting in insufficient vapor pressure, which lowers the efficiency of the lamp.

SUMMARY OF THE INVENTION

Therefore, to solve the above problems, it is an object of the present invention to provide a high-intensity discharge lamp whose luminous tube is improved in structure so as to enhance luminous efficiency and color rendering, and so as to reduce a starting voltage when the lamp is turned on, ultimately reducing power consumption.

To accomplish the above object of the present invention, there is provided a high-intensity discharge lamp comprising a luminous tube in which predetermined rare gases and metal are sealingly filled, and a pair of electrodes provided at the ends of the luminous tube, wherein irregular portions are formed at both ends of the luminous tube which surround the electrodes.

BRIEF DESCRIPTION OF THE DRAWINGS

The above object and advantages of the present invention will become more apparent by describing in detail a preferred embodiment of the present invention with reference to the attached drawings in which.

DETAILED DESCRIPTION OF THE INVENTION

Figure 1:
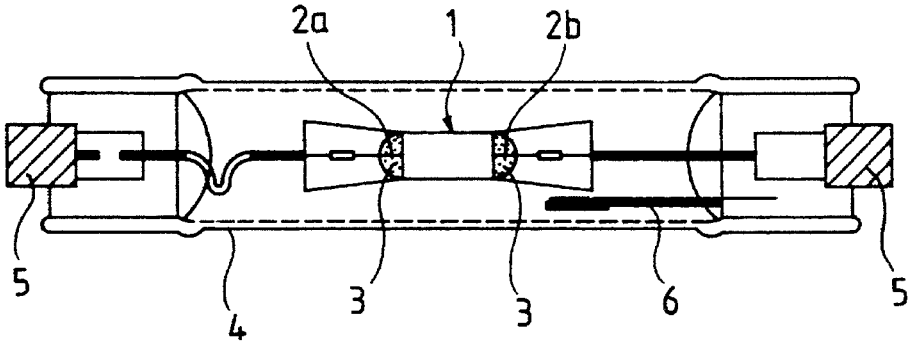
FIG. 1 (PRIOR ART)
FIG. 1 shows an example of a conventional metal halide lamp.
Figure 2:
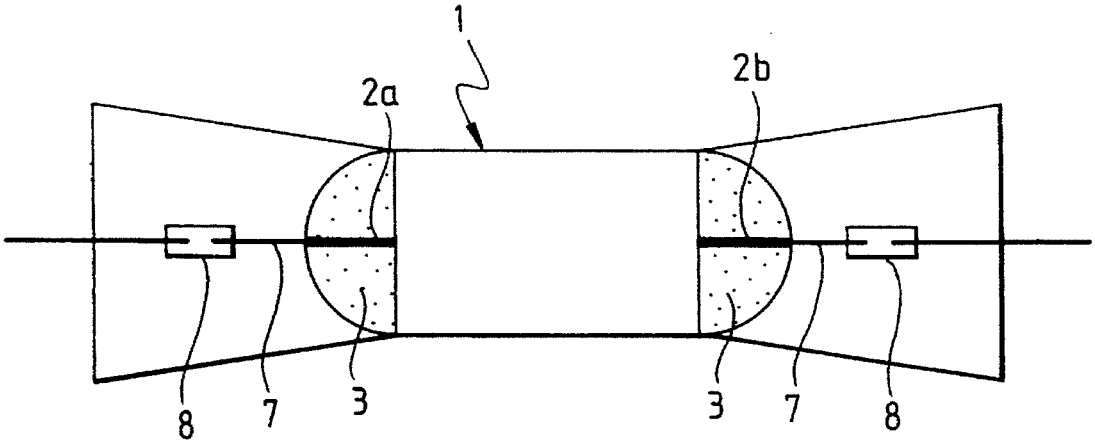
FIG. 2 (PRIOR ART)
FIG. 2 is an enlarged view of the luminous tube of the lamp shown in FIG. 1.
Figure 3:
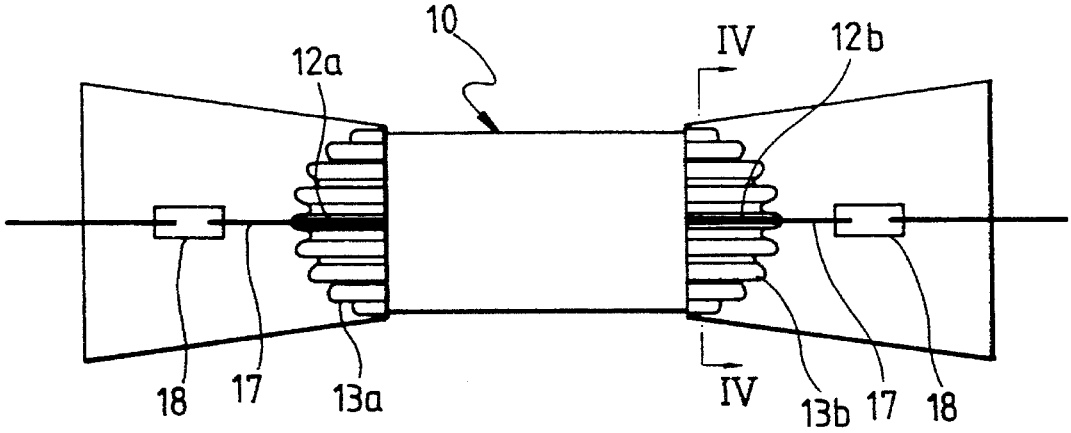
FIG. 3 is a side view of a luminous tube of a high-intensity discharge lamp of the present invention.

Referring to FIG. 3, a luminous tube 10 is capsule-shaped. A sawtoothed irregular portion 13*a* or 13*b* is formed on the inner and outer circumferential surfaces of luminous tube 10 at either end of the capsule-shaped body. Here, the irregular portion 13*a* or 13*b* internally reflects a considerable amount of light which is externally transmitted from the tube 10, contrary to the conventional smooth surface. Thus, the internal temperature of luminous tube 10 is increased accordingly, thereby raising the vapor density of the inside of the luminous tube 1. Particularly, the rugged portions 13*a* and 13*b* yield the same effect as the conventional heat-retaining layer without the layer. Eventually, this brings about a simplification in the manufacturing process and a reduction in production costs.

A pair of opposing electrodes 12*a* and 12*b* are provided in luminous tube 10 at both lengthwise ends thereof. A lead wire 17 is drawn out from each electrode. On each lead wire is installed a molybdenum thin plate 18 for maintaining a gas-tight seal.

Figure 4:
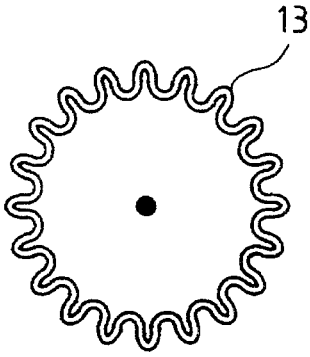
FIG. 4 is a cross-sectional view of the luminous tube taken along line IV—IV of FIG. 3.

FIG. 4 is a cross-sectional view of the luminous tube shown in FIG. 3 taken along a line IV—IV of FIG. 3. As shown in FIG. 4, the end of luminous tube 10 surrounding the electrodes is formed with a sawtoothed irregular portion 13*b* having undulations on the inner peripheral surface of the tube 10. The undulations are formed by pleats extending in the longitudinal direction of the tube 10. Each pleat has a pair of opposing sides spaced by a gap and converging in the radially outward direction of the tube 10. As described above, such a shape irregularly reflects again inwardly a considerable amount of the light which is externally transmitted from the tube. Accordingly, the internal temperature of the tube is maintained a high and substantially uniform. Thus, the vaporization density of the filled metal halide is kept sufficiently high, thereby significantly improving luminous efficiency. Furthermore, the irregular reflection of light to be externally transmitted for color rendering enhances visibility greatly.

Figure 5:
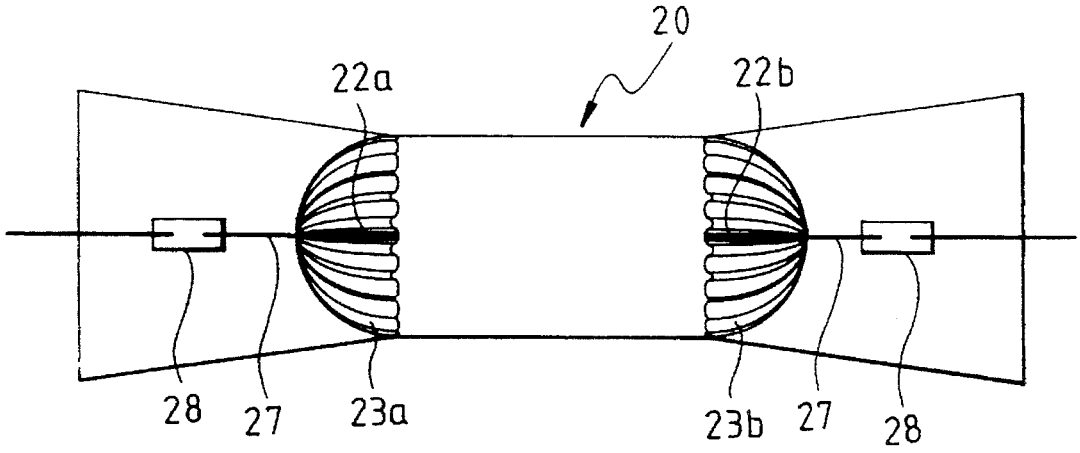
FIGS. 5 and 6 are side views of other embodiments of a luminous tube of the high-intensity discharge lamp of the present invention.
Figure 6:
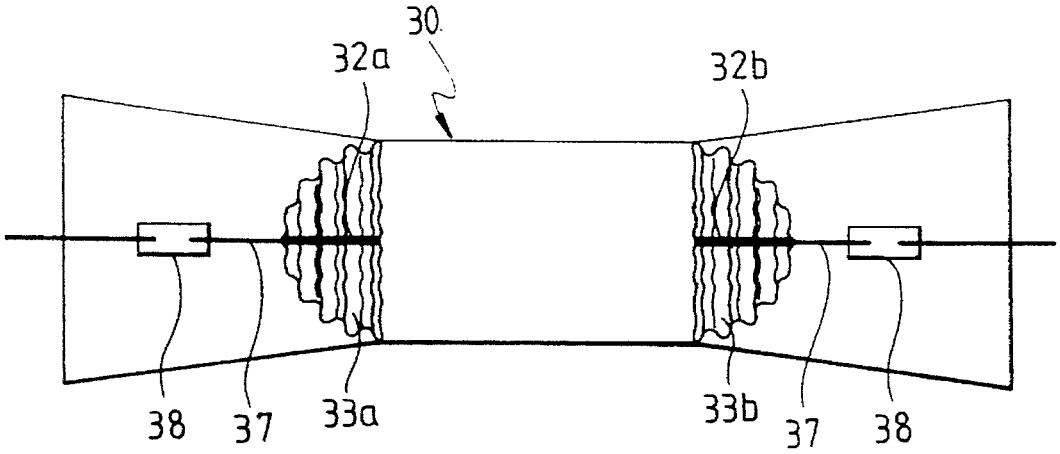

Referring to FIGS. 5 and 6, reference numerals 22*a*, 22*b*, 32*a* and 32*b* indicate electrodes, reference numerals 23*a*, 23*b*, 33*a* and 33*b* indicate irregular portions, reference numerals 27 and 37 indicate lead wires, and reference numerals 28 and 38 indicate molybdenum thin films. Specifically referring to FIG. 5, a pleated irregular portion 23*a* or 23*b* is provided at each lengthwise end of luminous tube 20. However, unlike sawtoothed irregular portions 13*a* and 13*b* shown in FIG. 3, the pleated irregular portions 23*a* and 23*b* are radially formed on the inner and outer circumferential surfaces of the luminous tube, taking as its center point, the apex of a parabola placed at the ends of luminous tube 20. The structure of such an irregular portion is advantageous in that the areas where mercury is cooled and condensed (returns to a liquid state) as the lamp is turned off are dispersed so as to expand the surface area of the mercury and to thereby lower the starting voltage when the lamp is turned on again. This, ultimately, reduces power consumption.

Turning to FIG. 6, in contrast to irregular portions 13*a* and 13*b* of luminous tube of FIG. 3 which are lengthwise to luminous tube 10, the orientation of pleats of the irregular portions 33*a* and 33*b* of luminous tube 30 of FIG. 6 are perpendicular to the length of luminous tube 30. Each pleat has opposing sides extending outward with respect to the length of the tube 30. Particularly, when irregular portions 33*a* and 33*b* of FIG. 6 are perpendicular to the length of luminous tube 30 and the respective lines of the pleats are roughened, light is reflected more irregularly. This achieves excellent color rendering.

Although the above-discussed embodiments of the present invention have been explained with respect to an MHL, the embodiments can be applied to all kinds of high-intensity discharge lamps including a high-intensity mercury lamp and high-intensity natrium lamp.

As described above, the high-intensity lamp of the present invention exhibits excellent color rendering because irregular portions are formed at both ends of the luminous tube so as to irregularly reflect light. The irregular portions also uniformly maintain the inside of the luminous tube at a high temperature so as to expedite vaporization and to thereby increase the luminous efficiency of the lamp. Furthermore, the irregular portions broaden the surface area of the mercury condensed when the lamp is turned off, and therefore reduce the starting voltage. Without the conventional heat-retaining layer, the present invention is advantageous in simplifying the manufacturing process and reducing production costs. In addition, since the present invention does not use a chemical material as a liquid for the heat-retaining layer, the working environment is improved.

What is claimed is:

1. A high-intensity discharge lamp comprising a luminous tube in which a rare gas and a metal are sealed and a pair of electrodes provided at first and second ends of the luminous tube, a transverse cross section of the tube surrounding each electrode having an inner peripheral surface with undulations for internally reflecting light from the electrodes.

2. A high-intensity discharge lamp as claimed in claim 1 wherein the undulations comprises pleats extending in a longitudinal direction of the tube.

3. A high-intensity discharge lamp as claim in claim 2 wherein the pleats are parallel to each other.

4. A high-intensity discharge lamp as claimed in claim 2 wherein a plurality of the pleats converge at each end of the tube.

5. A high-intensity discharge lamp as claimed in claim 4 wherein each pleat extends along a parabola centered on a longitudinal axis of the tube.

6. A high-intensity discharge lamp as claimed in claim 4 wherein the tube comprises a generally cylindrical midportion and the pleats extend to the midportion.

7. A high-intensity discharge lamp as claimed in claim 2 wherein each pleat comprises a pair of opposing sides spaced by a gap and converging in a radial direction of the tube.

8. A high-intensity discharge lamp as claimed in claim 1 wherein the pleats extend along parabolas centered on a longitudinal axis of the tube.

9. A high-intensity discharge lamp as claimed in claim 1 wherein the undulations are regularly spaced about the inner peripheral surface of the tube.

10. A high-intensity discharge lamp as claimed in claim 1 wherein the transverse cross section is substantially circular.

11. A high-intensity discharge lamp comprising a luminous tube in which a rare gas and a metal are sealed and a pair of electrodes provided at first and second ends of the luminous tube, each end of the tube being formed with a plurality of pleats for internally reflecting light from the electrodes, the pleats extending around a circumference of the tube and having opposite sides extending outward with respect to a longitudinal axis of the tube, outer diameters of the pleats decreasing towards the ends of the tube.

12. A high-intensity discharge lamp as claimed in claim 11 wherein undulations are formed on each pleat around a circumference of the tube.

13. A high-intensity discharge lamp comprising a luminous tube in which a rare gases gas and a metal are sealed and a pair of electrodes provided at first and second ends of the luminous tube, each end of the tube having formed on a surface thereof, around an entire circumference of the tube and surrounding one of the electrodes, a plurality of longitudinally-extending pleats for internally reflecting light from the one of the electrodes.

14. A high-intensity discharge lamp as claimed in claim 13 wherein the pleats are formed on an inner peripheral surface of the tube.

15. A high-intensity discharge lamp as claimed in claim 13 wherein each pleat comprises a pair of opposing sides spaced by a gap and converging in a radial direction of the tube.

* * * * *